US007806815B2

(12) United States Patent
Fernandez et al.

(10) Patent No.: US 7,806,815 B2
(45) Date of Patent: Oct. 5, 2010

(54) CORE TRAINER

(76) Inventors: Juan Fernandez, P.O. Box 312, Towaco, NJ (US) 07082; Paul McGrath, P.O. Box 312, Towaco, NJ (US) 07082; Robert Kennedy, 464 Bay Street, Ottawa, ON (CA) K1R-6A8

( * ) Notice: Subject to any disclaimer, the term of this patent is extended or adjusted under 35 U.S.C. 154(b) by 54 days.

(21) Appl. No.: 12/220,762

(22) Filed: Jul. 28, 2008

(65) Prior Publication Data

US 2010/0022368 A1 Jan. 28, 2010

(51) Int. Cl.
*A63B 26/00* (2006.01)
*A63B 21/04* (2006.01)

(52) U.S. Cl. ..... 482/140; 482/129

(58) Field of Classification Search ..... 482/72, 482/95–96, 129–130, 121, 140
See application file for complete search history.

(56) References Cited

U.S. PATENT DOCUMENTS 2,855,199 A * 10/1958 Noland et al. ..... 482/97
4,917,379 A 4/1990 Maag
5,000,444 A 3/1991 Dalebout
5,277,684 A * 1/1994 Harris ..... 482/130
5,409,435 A 4/1995 Daniels
5,456,644 A 10/1995 Hecox et al.
5,533,953 A * 7/1996 Lui et al. ..... 482/96
5,603,681 A * 2/1997 Olschansky et al. ..... 482/129
5,632,710 A 5/1997 England et al.
5,720,702 A * 2/1998 Lee ..... 482/129
5,800,323 A * 9/1998 Ansel ..... 482/129
5,895,343 A * 4/1999 Huang ..... 482/123
6,186,926 B1 2/2001 Ellis
6,387,024 B1 * 5/2002 Monti et al. ..... 482/142
6,390,960 B1 5/2002 Boland
6,634,997 B2 10/2003 Breibart et al.
6,652,430 B2 11/2003 Lapcevic
6,676,573 B2 1/2004 Abelbeck et al.
6,984,196 B2 1/2006 Tornabene et al.
2001/0053734 A1 12/2001 Lapcevic
2002/0142898 A1 10/2002 Willis et al.
2002/0183173 A1 12/2002 Abelbeck et al.
2003/0078143 A1 4/2003 Breibart et al.
2004/0058790 A1 * 3/2004 Lapcevic ..... 482/123
2007/0037677 A1 2/2007 Splane, Jr.
2007/0042880 A1 2/2007 Ratner
2007/0287619 A1 12/2007 Tuller

* cited by examiner

*Primary Examiner*—Fenn C Matthew
(74) *Attorney, Agent, or Firm*—Gearhart Law, LLC.

(57) ABSTRACT

The present invention is an exercise machine that is versatile, easily adjustable, and easy to store and transport. The machine may be used by varying sizes of users for a wide variety of exercises to increase strength. The Core trainer is comprised of a seat with a press bar attached to an adjustable arm, which is attached to a resistance arm. The press bar is available in various interchangeable designs. A pivot allows the adjustable arm and resistance arm to be placed in varying positions in relation to the seat to provide for a multitude of exercise options. The Core trainer can be used with a number of attachments, and also folds into a compact unit that takes up a fraction of the space of other exercise machines.

16 Claims, 12 Drawing Sheets

CORE TRAINER

FIELD OF THE INVENTION

This invention relates to the field of exercise equipment, in particular to exercise equipment used to strengthen abdominal muscles.

BACKGROUND OF THE INVENTION

This invention relates to the field of exercise equipment, in particular to exercise equipment used to strengthen abdominal muscles.

The present invention relates to resistance machines for exercise. The prior art is replete with examples of exercise machines. Exercise machines known in the art, such as weight benches, often comprise a frame with a shaft and a pivot arm attached to it. Weights are loaded on the shaft, and the pivot arm functions as a handle for the person exercising. In some machines, the exerciser has the option of moving the handle to one of several positions before using the machine. This option enables the user to exercise several different muscle groups with the same machine. In order to move the pivot arm of the weight benches presently known in the art, the exerciser must remove the weights on the shaft, adjust the handle and replace the weights before beginning to exercise. This process is tedious and time consuming. The person exercising wastes valuable time removing and replacing weights. An exercise machine that does not require removing the weights to adjust the pivot arm saves exercisers' time and also increases their enjoyment of the machine.

Prior art exercise machines commonly provide weights as a source of resistance. However, resistive force may also be created by different mechanisms. Rubber elements used as stretchable members have been widely used to oppose motion of certain mechanisms in an exercise machine. Many of the resistance mechanisms known in the art are complicated and cumbersome. An exercise machine that is easy to adjust so that different muscle groups can be exercised, and that is simple and durable, would be a welcome improvement.

Many exercise machines are bulky and not only take up space, they are not easily transported or even easily moved within a room. Thus, space must be dedicated to the machine. This may make it less desirable for some exercisers to purchase the machine.

U.S. Pat. No. 4,917,379 teaches an arm extension exercise machine which utilizes a frame-journaled rotating effort arm which is mechanically linked to a frame-journaled rotating weight arm which, together with the frame of the machine and the connecting link joining them, form a simple planar double-rocking-lever four-bar linkage which acts in conjunction with the rotating weight arm to vary the resistive force applied to an operator's arm extending muscles through body-machine contact with the rotating effort arm throughout the range of the exercise movement.

U.S. Pat. No. 5,277,684 teaches a multi-function exercise apparatus that has a base frame including two vertical support members. An adjustable support means is secured to the frame and provides support for a user in a plurality of different upright and horizontal exercise positions. A lever arm is mounted to a fixed shaft extending from each of the two support members, and an elastic band biasing means cooperatively engages each lever arm and corresponding support member thereof so that each lever arm is adapted to have its forward or rearward rotational bias changed without requiring removal and relocation of the lever arm, the corresponding elastic bands, or the corresponding band support pins.

U.S. Pat. No. 5,456,644 teaches an exercise apparatus comprising a frame, a pivot arm mounted on the frame, a resistance mechanism, preferably an elastomeric torsion member, and a positioning element which allows the pivot arm to be pivotally adjusted with respect to the frame, independent of the resistance element, so as to vary the neutral position of the pivot arm. The preferred embodiment may also comprise a shaft mounted to the frame for conveying torque to the elastomeric torsion member and a support arm mounted to the frame to oppose rotation of the elastomeric torsion member about the shaft. In one embodiment, the exercise apparatus takes the form of a weight bench. In a second embodiment, the exercise apparatus is a home gym.

U.S. Pat. No. 5,632,710 teaches an exercise apparatus comprising a frame, a pivot arm mounted on the frame, a resistance mechanism, preferably an elastomeric torsion member, and a positioning element which allows the pivot arm to be pivotally adjusted with respect to the frame, independent of the resistance element, so as to vary the neutral position of the pivot arm. The preferred embodiment may also comprise a shaft mounted to the frame for conveying torque to the elastomeric torsion member and a support arm mounted to the frame to oppose rotation of the elastomeric torsion member about the shaft. In one embodiment, the exercise apparatus takes the form of a weight bench. In a second embodiment, the exercise apparatus is a home gym. In a third embodiment, the exercise machine comprises a frame, a pivot arm pivotally mounted on the frame, the pivot arm having a neutral position, the pivot arm configured to be moveable alternatively by the front and the back of a user's body, and at least one resistance member connected to the pivot arm for creating bidirectional resistance to movement of the pivot arm. In the third embodiment the machine preferably also comprises a seat, for supporting a user rotatably connected to the frame. The invention also includes the method of using the machine to perform various exercises.

U.S. Pat. No. 6,186,926 teaches a seated abdominal exercise machine that includes a frame, a seat mounted to the frame and a backrest attached to the frame rearwardly of the seat. An arm and head support assembly is mounted for rotary movement to the frame and provides a resistance adapted to be moved by an exerciser occupied in the seat. A motion translation arrangement is pivotally mounted between the frame and the arm and head support assembly for providing an unrestricted, full range abdominal crunching motion for the seated exerciser. The machine relies upon a series of transfer members pivotally interconnected together between the frame and the arm and head support assembly and moving about a first fixed horizontal axis passing through the backrest, a first movable horizontal axis passing through the arm and head support assembly, a second fixed horizontal axis passing through the frame at a location offset from the first fixed horizontal axis, and a second movable horizontal axis which moves rearwardly and upwardly relative to the frame when a downward force is exerted upon the arm and head support assembly.

U.S. Pat. No. 6,390,960 teaches a portable exercise device identified for abs and hips conditioning comprising a generally rectangular, rigid frame supporting a tilted seat and laterally aligned, handle bars used for hand bracing when the user is seated thereon. A single lever arm of an elbow configuration is transversely disposed above the seat and is adapted for pivotal lifting which is affected by the thigh movements. The device has a moment means positioned beneath the seat, which means is operatively tied to the lever arm pivot point. Resilient tensioning means are also secured to the frame and provide the variable countervailing force needed to resist the user imposed arcuate movement of the lever arm.

U.S. Pat. No. 6,634,997 teaches an invention that is an improved Pilates chair having a seat top with an underside, a base that is wider than the seat top, a plurality of bracing members between the seat top and the base, a swingable lever having an upper end and a lower end disposed between the seat top and the base, the lower end being hingeably attached from the base, an adjusting block disposed slidably along the lever between the upper and lower ends thereof, means on the adjusting block for locking it in a position along the lever, and one or more elongated helical springs each having two ends, one of the ends being attached from the underside of the seat top, and the other end being attached from the adjusting block, whereby sliding said adjusting block along said lever, and locking it in a position therealong, will result in a greater or lesser extent of stretch being imparted to the at least one helical spring.

U.S. Pat. No. 6,652,430 teaches a training apparatus designed to improve the physical readiness level of the low back and pelvic girdle of an individual includes a frame, a seat, a pivot mechanism mounted on the frame and providing a pivot point, an exercise arm rotatable about the pivot point, and a resistance assembly rotatable about the pivot point. An interlocking mechanism interlocks the exercise arm and the resistance assembly such that they rotate as a single unit about the pivot point of the pivot mechanism. The angle between the exercise arm and the resistance assembly is selectable. The resistance assembly includes at least a first resistance lever arm and, preferably, a second resistance lever arm. The first resistance lever arm includes a counterweight. The second resistance lever arm has a weight attachment mechanism for attaching a stress weight thereto, and the second resistance lever arm is angularly offset from the first resistance lever arm by an angle about the pivot point of the pivot mechanism.

U.S. Pat. No. 6,676,573 teaches a multiple function exercise device that enables simultaneous exercise of several muscle groups. The device includes a chest pad that is stationary to the support frame and a seat that moves in a path of motion that enables the user's chest to remain on the chest pad as the user's legs are extended, thereby causing movement of the seat. This combination provides activation of the leg and hip extensor muscles and the trunk flexor muscles at the same time. In another embodiment, a resistance arm is added that is pivotally attached to the frame and mechanically linked to the seat, thereby causing movement of the arm as the seat moves. This allows the additional activation of the triceps muscles, or elbow extensors of the upper arm, while also working the leg and hip extensor muscles and the trunk flexor muscles all in a single movement. The advantage to such a movement is the time saving effect of working a large group of muscles at one time as opposed to several exercises one after the other.

U.S. Pat. No. 6,984,196 teaches an abdominal exercise machine which includes a seat, which is pivotally linked to a base frame. At least one link includes a handle that can be actuated by a user sitting on the seat. The user presses the handle away from the seat by flexing the trunk muscles of the user. This curls the user's body into a flexed trunk position. As the handle is actuated forward, the linkage arrangement causes the seat to displace upward. This pushes the center of gravity of the user up, thereby doing work and thereby providing resistance to the movement caused by the exercise. The handle may be adjustable in position relative to the link, thereby varying the load used by the user. Foot supports may also be provided either in front of the seat or behind the seat. The foot supports may be mounted to the frame of the seat frame which supports the seat.

U.S. patent application Ser. No. 20010053734 teaches a training apparatus designed to improve the physical readiness level of the low back and pelvic girdle of an individual includes a frame, a seat, a pivot mechanism mounted on the frame and providing a pivot point, an exercise arm rotatable about the pivot point, and a resistance assembly rotatable about the pivot point. An interlocking mechanism interlocks the exercise arm and the resistance assembly such that they rotate as a single unit about the pivot point of the pivot mechanism. The angle between the exercise arm and the resistance assembly is selectable. The resistance assembly includes at least a first resistance lever arm and, preferably, a second resistance lever arm. The first resistance lever arm includes a counterweight. The second resistance lever arm has a weight attachment mechanism for attaching a stress weight thereto, and the second resistance lever arm is angularly offset from the first resistance lever arm by an angle about the pivot point of the pivot mechanism. Also disclosed is a seating and positioning apparatus which includes a thigh engagement device for contacting and restraining an upper surface of a thigh of an individual using the training device.

U.S. patent application Ser. No. 20020142898 teaches an office chair and office desk independently incorporating certain activity features into the chair and desk arrangements allowing the user to perform beneficial exercise without leaving the chair or desk by utilizing movable exercise arms attached to adjustable variable resistance bearing assemblies attached to the chair seat or the desk to provide a full range of omnidirectional exercises.

U.S. patent application Ser. No. 20020183173 teaches a multiple function exercise device that enables simultaneous exercise of several muscle groups. The device includes a chest pad that is stationary to the support frame and a seat that moves in a path of motion that enables the user's chest to remain on the chest pad as the user's legs are extended, thereby causing movement of the seat. This combination provides activation of the leg and hip extensor muscles and the trunk flexor muscles at the same time. In another embodiment, a resistance arm is added that is pivotally attached to the frame and mechanically linked to the seat, thereby causing movement of the arm as the seat moves. This allows the additional activation of the triceps muscles, or elbow extensors of the upper arm, while also working the leg and hip extensor muscles and the trunk flexor muscles all in a single movement. The advantage to such a movement is the time saving effect of working a large group of muscles at one time as opposed to several exercises one after the other.

U.S. patent application Ser. No. 20030078143 teaches an improved Pilates chair having a seat top with an underside, a base that is wider than the seat top, a plurality of bracing members between the seat top and the base, a swingable lever having an upper end and a lower end disposed between the seat top and the base, the lower end being hingeably attached from the base, an adjusting block disposed slidably along the lever between the upper and lower ends thereof, means on the adjusting block for locking it in a position along the lever, and one or more elongated helical springs each having two ends, one of the ends being attached from the underside of the seat top, and the other end being attached from the adjusting block, whereby sliding said adjusting block along said lever, and locking it in a position therealong, will result in a greater or lesser extent of stretch being imparted to the at least one helical spring.

U.S. patent application Ser. No. 20040058790 teaches a training apparatus designed to improve the physical readiness level of the low back and pelvic girdle of an individual includes a frame, a seat, a pivot mechanism mounted on the frame and providing a pivot point, an exercise arm rotatable about the pivot point, and a resistance assembly rotatable about the pivot point. An interlocking mechanism interlocks the exercise arm and the resistance assembly such that they rotate as a single unit about the pivot point of the pivot mechanism. The angle between the exercise arm and the resistance assembly is selectable. The resistance assembly includes at least a first resistance lever arm and, preferably, a second resistance lever arm. The first resistance lever arm includes a counterweight. The second resistance lever arm has a weight attachment mechanism for attaching a stress weight thereto, and the second resistance lever arm is angularly offset from the first resistance lever arm by an angle about the pivot point of the pivot mechanism. Also disclosed is a seating and positioning apparatus which includes a thigh engagement device for contacting and restraining an upper surface of a thigh of an individual using the training device.

U.S. patent application Ser. No. 20070037677 and International Patent Application WO2007092045 teach an exercise chair primarily directed to employing an exercise method, with independent, adjustable foot bars and a foldable configuration. The seat is supported by a plurality of support elements, at least some of which are hingeably connected with the seat, so that the chair can be folded into a compact shape for storage or transport. The independent foot bars may each be attached to a lever that is hingeably coupled with one or more of the support elements. The position of the foot bars may also be adjustable by extending out of the levers and locking into the desired position. One or more resistance elements may be removably attached to a location below the chair seat, and individually connected with the levers via an adjusting assembly that can either slide or be placed in pre-set mounting locations along the lever to provide variable resistance, or can be equipped with a turnbuckle to provide varying resistance. A platform that rests at or near the floor during use may be attached to the two front support elements, which provides stability as well as comfort when the user stands or kneels on the platform when using the chair.

U.S. patent application Ser. No. 20070042880 teaches the construction of a collapsible rotary torso exercise machine. The machine's extended parts fold down and/or detach so that it may be stored in a small space. The machine is also lightweight and therefore portable. Three different types of resistance mechanism are specifically disclosed: 1) piston in cylinder resistance 2) friction resistance and 3) elastic member resistance. The collapsible rotary torso exercise machine preferably has variable resistance and for each type of resistance mechanism disclosed, a mechanism or method for varying the resistance is also disclosed.

U.S. patent application Ser. No. 20070287619 teaches an abdominal exerciser in which the body floats with respect to the exerciser frame, which leads to isolating the abdominal muscles. The exerciser includes a seat; a frame adapted to support said seat in a position that is raised off a floor; a seat pivot connecting said seat and frame, said pivot located under said seat; an upper body arm adapted to engage the upper body of a user; an upper body arm pivot connecting said seat and said upper body arm; and a lower body arm attached to said seat.

European Patent EPO 183635 teaches an exercise machine that includes side frame members. Electromagnetic brakes supported on movable carriages slide along side frame members. Carriages include a hinge for allowing each brake to pivot between multiple positions. Both types of motion allow the output shafts on brakes to be reoriented relative to a support bench on which a user of the machine is located. Various exercise attachments may be coupled to brake output shafts for contacting various body members to perform different exercises. A controller regulates the force levels of brakes.

Much of the prior art relies on bulky weights to provide strength training. These weights must be stored on or near the machine, and are cumbersome to move when adjusting the resistance on the machine. Other prior art consists of machines that are bulky themselves and must be stationarily positioned in a room, where they take up space permanently. Other machines are designed to exercise only one or a few muscle groups, thereby rendering it necessary to buy other machines or means for exercising the remaining muscle groups.

The present invention has advantages that the prior art lacks. In a preferred embodiment, the present invention uses tension bands to provide resistance. Resistance is increased by increasing the number of bands, thus rendering it easy to use and adjust. This speeds workout time and reduces user frustration. The invention is also easily stored and transported in that it can be folded into a relatively compact form. The invention is also versatile; it can be easily employed in a variety of ways with a variety of attachments to provide strength training for a large number of different muscle groups. Additionally, the Core trainer can be adjusted to the size of the user, therefore both small and larger users can employ the same machine correctly, thereby avoiding injuries caused by incorrect use. None of the prior art combines the advantages described above in one machine.

SUMMARY OF THE INVENTION

The present invention is an exercise machine, comprising a support assembly, a seat assembly, a resistance assembly which has a gear wheel fixed to the support assembly, and a resistance arm rotatably attached to the gear wheel. The resistance arm has means to adjustably affix the resistance arm to the gear wheel, and the resistance arm has a resistance attachment means. Also included is an arm assembly having an attachment point, and a resistance band having an end attached to the attachment point and the other end attached to the resistance attachment point.

The present invention is a strength training machine that is versatile, allowing a variety of muscle groups to be exercised using one machine, either with or without attachments. The invention is easy to use and easy to adjust. It is also easily stored and transported in that it can be folded into a compact unit, and it employs light weight resistance means rather than heavy, bulky weights to provide strength training.

It is an object of the invention to provide a means for strengthening a variety of muscle groups using a single machine.

It is an object of the invention to provide a machine for strengthening the abdominal muscles.

It is an object of the invention to provide a machine for strengthening the upper body.

It is an object of the invention to provide a machine for strengthening the lower body.

It is an object of the invention to provide a versatile strength training machine that is easy to use and adjust.

It is an object of the invention to provide a strength training machine that is easily stored and transported.

It is an object of the invention to provide a strength training machine that can be easily customized to the size of the user.

It is an object of the invention to provide a strength training machine that can be easily customized to the needs of the user.

DESCRIPTION OF THE PREFERRED EMBODIMENTS

Figure 1:
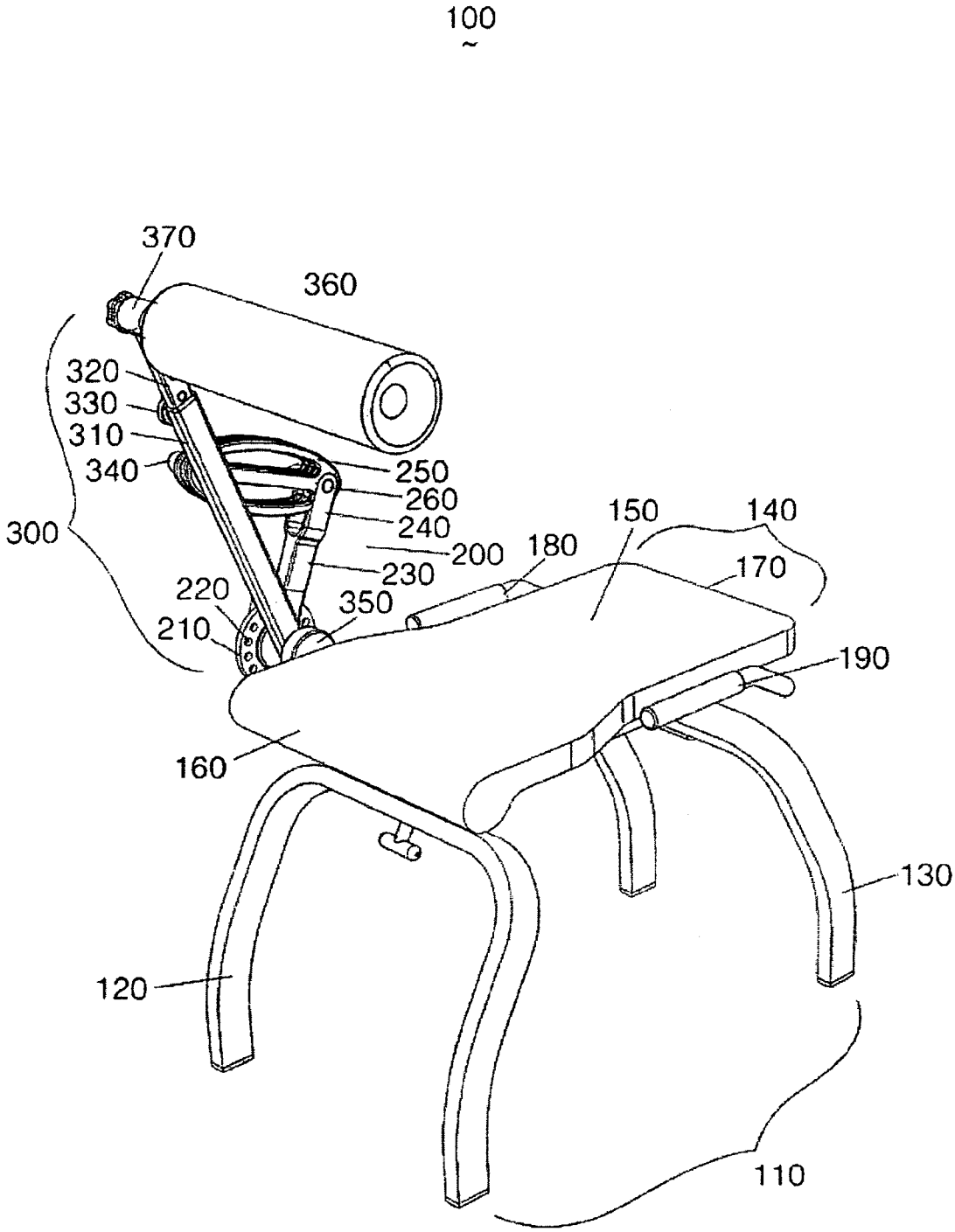
FIG. 1 is a perspective view of the invention.

FIG. 1 is perspective view of the invention, core trainer 100. Core trainer 100 has support assembly 110, which consists of front legs 120, rear legs 130, seat assembly 140, seat 150, seat front curved portion 160, seat rear curved portion 170, a first handle 180, and a second handle 190.

FIG. 1 also shows the resistance assembly 200, with gear wheel 210, gear wheel holes 220, resistance arm 230, resistance attachment means 240, resistance band 250, and resistance attachment point 260. Also shown is the arm assembly 300, with arm 310, arm extension 320, extension knob 330, band knob 340, arm assembly attachment point 350, press bar 360, and press bar attachment point 370.

In the embodiment illustrated in FIG. 1, a user sits on the seat 150 facing the front of the machine and places his chest against the press bar 360. He then pushes the bar forward and down using his abdominal muscles. The arm assembly attachment point 350 pivots to allow the arm assembly 300 to move with the press bar 360 while the resistance arm 230 stays stationary and the resistance band 250 stretches, thereby providing resistance to the user. The number and strength of the resistance bands 250 on the resistance assembly 200 determine the intensity of the exercise, and may be varied by the user. The user may brace himself by holding first handle 180 and second handle 190. There may be one handle, two or more handles, or no handles. Alternately, the handles may be included as a removable attachment.

The user may adjust the core trainer 100 to fit his body or to vary his exercise by adjusting the position of the press bar 360. This is done by adjusting the arm extension 320 by placing the extension knob 330 in the desired placement hole on the arm extension 320, which allows the press bar to be placed at varying heights.

Although the figures illustrate the arm assembly 300 and resistance assembly 200 attached to the right side of the core trainer 100 as the user faces the front, the arm assembly 300 and resistance assembly 200 may be attached anywhere on the core trainer 100, including in any position on the right side, left side, back, or front.

The user may also remove the press bar 360 and replace it with an alternate press bar or other object. This is done by unfastening the press bar 360 at the press bar attachment point 370, and subsequently attaching the alternate press bar. The press bar 360 may be a horizontal device as shown, or may be a vertical device. It may be any shape or size desired, including but not limited to, a cylinder as shown, a handle-grip bar, a full body bar, a bar that wraps part way around the upper torso, or a bar that allows for attachments, such as exercise bands or other exercise apparatus.

In a preferred embodiment the press bar 360 is a roller, which consists of a metal bar inside a vinyl covered foam pad, but the press bar 360 may be made from any material, including but not limited to, metal, fabric, foam, glass products including fiberglass, wood or wood products including paper products, plastics, rubbers, thermoplastics, and elastomers, or any combination of these materials or other materials that are useful. Also in this embodiment the press bar 360 is in a horizontal position, but it may be used in a vertical position or in any position between the two.

In a second preferred embodiment, the press bar 360 consists of a bar with hand grips. In this embodiment, the arm assembly 300 and resistance assembly 200 are moved using the hands instead of the chest, to exercise the user's arms. The press bar 360 of this embodiment may be horizontal or vertical and may contain hand grips anywhere on it or in it, and there may be multiple hand grips that are either all of the same design or of varying designs.

FIG. 1 also shows the seat 150 with a seat front curved portion 160 and a seat rear curved portion 170. The curved portion of the seat may be on both front and back, on either front or back, or not present at all. Alternatively, the curve of the seat may be an attachment that is employed only when desired by the user. The seat may employ curved portions that curve upward. Additionally, the curved portions of the seat may be anywhere on the seat, in any combination. For instance, one side of the seat 150 may employ a curved portion, either permanently or as an attachment. The seat assembly 140 may also have an extension that is either an attachment or that is an integral part of the core trainer 100.

Additionally, the seat 150 may include an adjustment so that it can be moved in relation to the arm assembly 300. As seen in the drawings, bench adjustment lever 142 can be pulled, allowing seat 150 to move back and forth. The adjustment mechanism 142 is preferably a clamp type bar. When moved to the down position, the clamp, which is a bent metal bar, releases pressure off the sliding seat. The seat can then slide forward or back. It could also be a spring mechanism, or a clamp type mechanism. The seat has a certain travel distance and can be set at any point in that travel.

The primary purpose for the sliding seat is for aligning the gear mechanism, which rotates, as close to rotation point on the body. Ab crunches would have a rotation about the hip. Leg lifts/extensions would have a desired rotation about the knee. In addition a shorter user may desire to have the seat positioned further forward in relation to the arm assembly, while a taller user may want the seat back further. There may also be varying exercises for which the user wishes to adjust the seat position. The seat position may also be altered by means such as, but not limited to, an extension mechanism similar to that of the arm extension 320, or by other means.

Not illustrated in the figures are various attachments that may be added to the core trainer 100. One such attachment involves exercise bands that may be attached, for instance to the front legs 120 or rear legs 130. Alternatively, the exercise bands may be attached to one front leg 120 and one rear leg 130 and the user may sit on the side of the seat, utilizing the exercise bands with hands or legs. These bands may be slipped over the legs, or there may be a built-in ring, pin, or other device for attaching the bands on the legs or anywhere on the core trainer 100. A further attachment may be wheels on the front legs 120 or rear legs 130 to make it easier to move the core trainer 100 across a surface.

Figure 2:
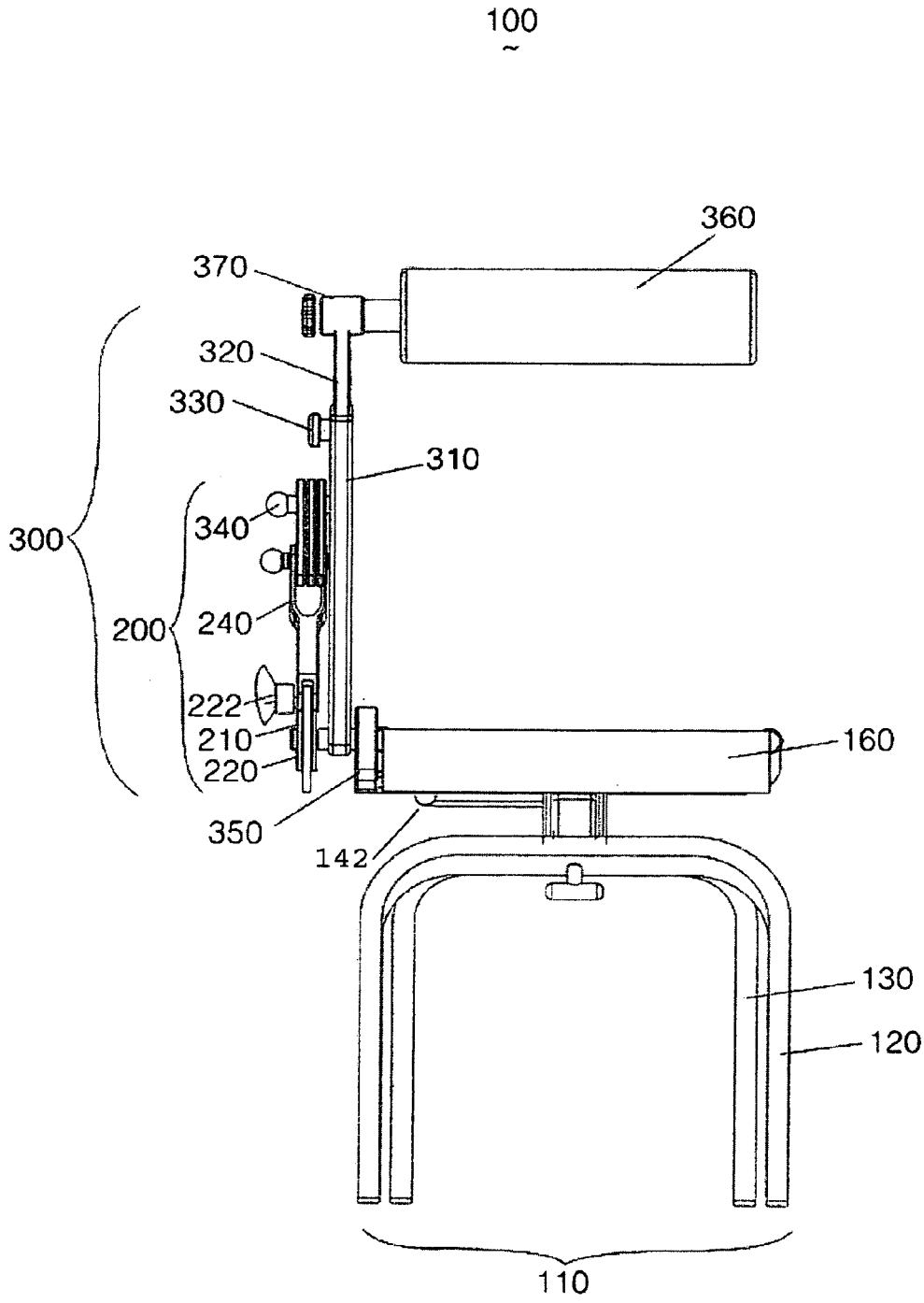
FIG. 2 is a front view of the invention.

FIG. 2 is a front view of the invention, core trainer 100. The core trainer 100 is illustrated with support assembly 110, front legs 120, rear legs 130, and seat front curved portion 160. Also shown from the front view in FIG. 2 is the resistance assembly 200, with gear wheel 210, gear wheel holes 220, gearwheel adjustment knob 222, resistance attachment means 240, and the arm assembly 300, with arm 310, arm extension 320, extension knob 330, band knob 340, arm assembly attachment point 350, press bar 360, and press bar attachment point 370.

Figure 3:
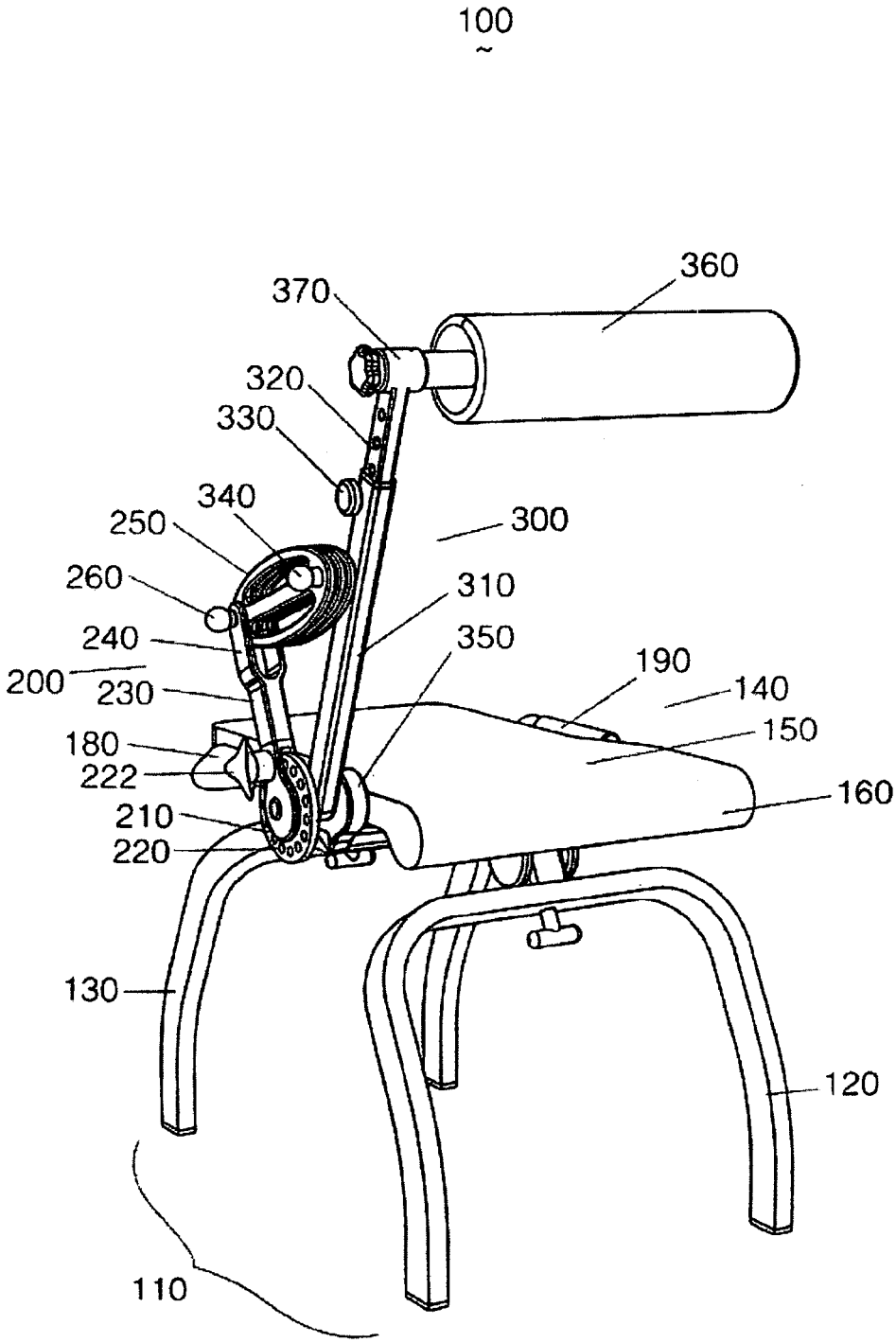
FIG. 3 is a front perspective view of the invention.

FIG. 3 is a front perspective view of the invention, core trainer 100. Core trainer 100 has support assembly 110, which consists of front legs 120, rear legs 130, seat assembly 140, seat 150, seat front curved portion 160, a first handle 180, and a second handle 190. Although the legs are shown in a partially bent configuration, they could be any shape. Moreover, the legs could be wider or bent outwards. The legs could also have wide pads or "feet" to add stability.

FIG. 3 also shows the resistance assembly 200, with gear wheel 210, gear wheel holes 220, gearwheel adjustment knob 222, resistance arm 230, resistance attachment means 240, resistance band 250, and resistance attachment point 260. Also shown is the arm assembly 300, with arm 310, arm extension 320, extension knob 330, band knob 340, arm assembly attachment point 350, press bar 360, and press bar attachment point 370.

Figure 4:
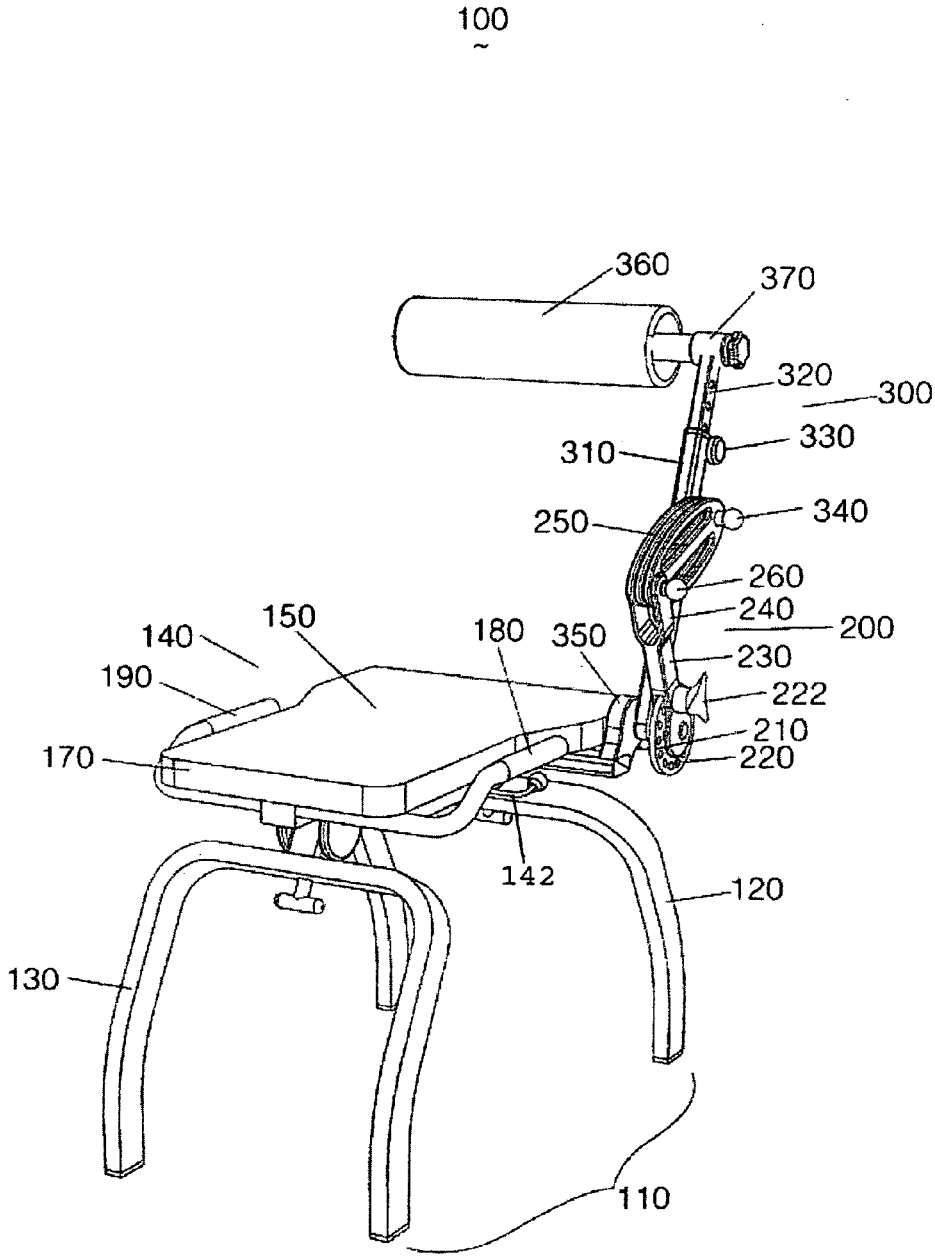
FIG. 4 is a rear perspective view of the invention.

FIG. 4 is a rear perspective view of the invention, core trainer 100. Core trainer 100 has support assembly 110, which consists of front legs 120, rear legs 130, seat assembly 140, sliding bench lever 142, seat 150, seat rear curved portion 170, a first handle 180, and a second handle 190.

FIG. 4 also shows the resistance assembly 200, with gear wheel 210, gear wheel holes 220, gearwheel adjustment knob 222, resistance arm 230, resistance attachment means 240, resistance band 250, and resistance attachment point 260. Also shown is the arm assembly 300, with arm 310, arm extension 320, extension knob 330, band knob 340, arm assembly attachment point 350, press bar 360, and press bar attachment point 370.

Figure 5:
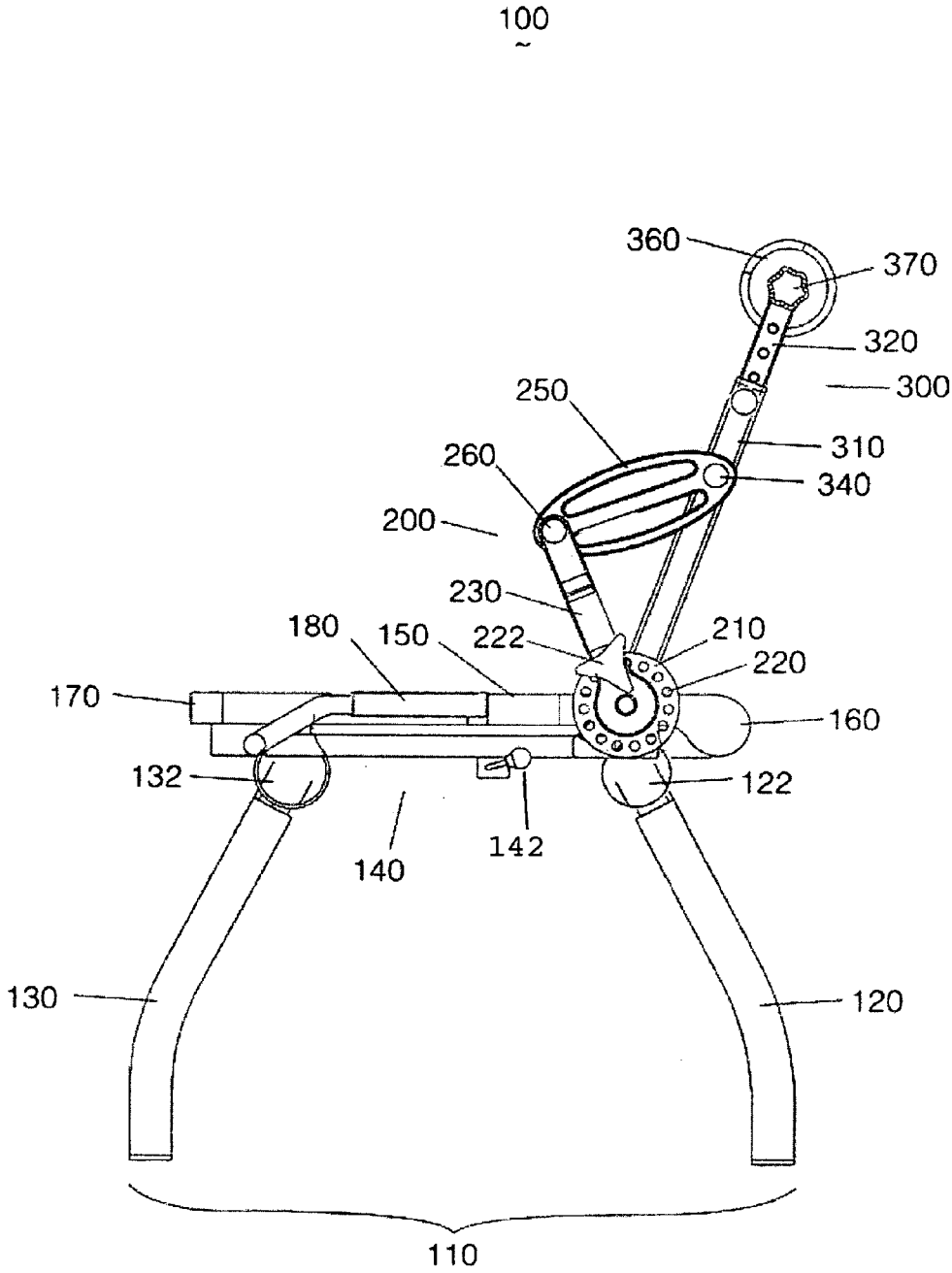
FIG. 5 is a side view of the invention.

FIG. 5 is a side view of the invention, core trainer 100. Core trainer 100 has support assembly 110, which consists of front legs 120, front legs folding joint 122, rear legs 130, rear legs folding joint 132, seat assembly 140, sliding bench lever 142, seat 150, seat front curved portion 160, seat rear curved portion 170, and a first handle 180.

FIG. 5 also shows the resistance assembly 200, with gear wheel 210, gear wheel holes 220, gearwheel adjustment knob 222, resistance arm 230, resistance band 250, and resistance attachment point 260. Also shown is the arm assembly 300, with arm 310, arm extension 320, band knob 340, press bar 360, and press bar attachment point 370.

The gear wheel 210 may be used to adjust the resistance arm 230 and arm assembly 300 to varying positions from 0 to 360 degrees by selecting the desired gear wheel hole 220. For instance, the resistance assembly 200 may be attached to the arm assembly 300 on the front side of the core trainer 100 rather than on the backside. This is accomplished by moving the gearwheel adjustment knob 222 to a forward position on the gearwheel 210 by moving it into a forward gear wheel hole 220.

In FIG. 5, the gearwheel adjustment knob 222 is in a clockwise position of 11:00. It can be moved to the gearwheel hole 220 that is in the 2:00 position, thereby moving the arm assembly 300 to the front of the core trainer 100. In this embodiment, the user may pull back on the press bar 360 rather than push on the press bar 360. This allows the user to exercise different muscle groups by changing the position of the resistance assembly 200 in relation to his body position.

Figure 6:
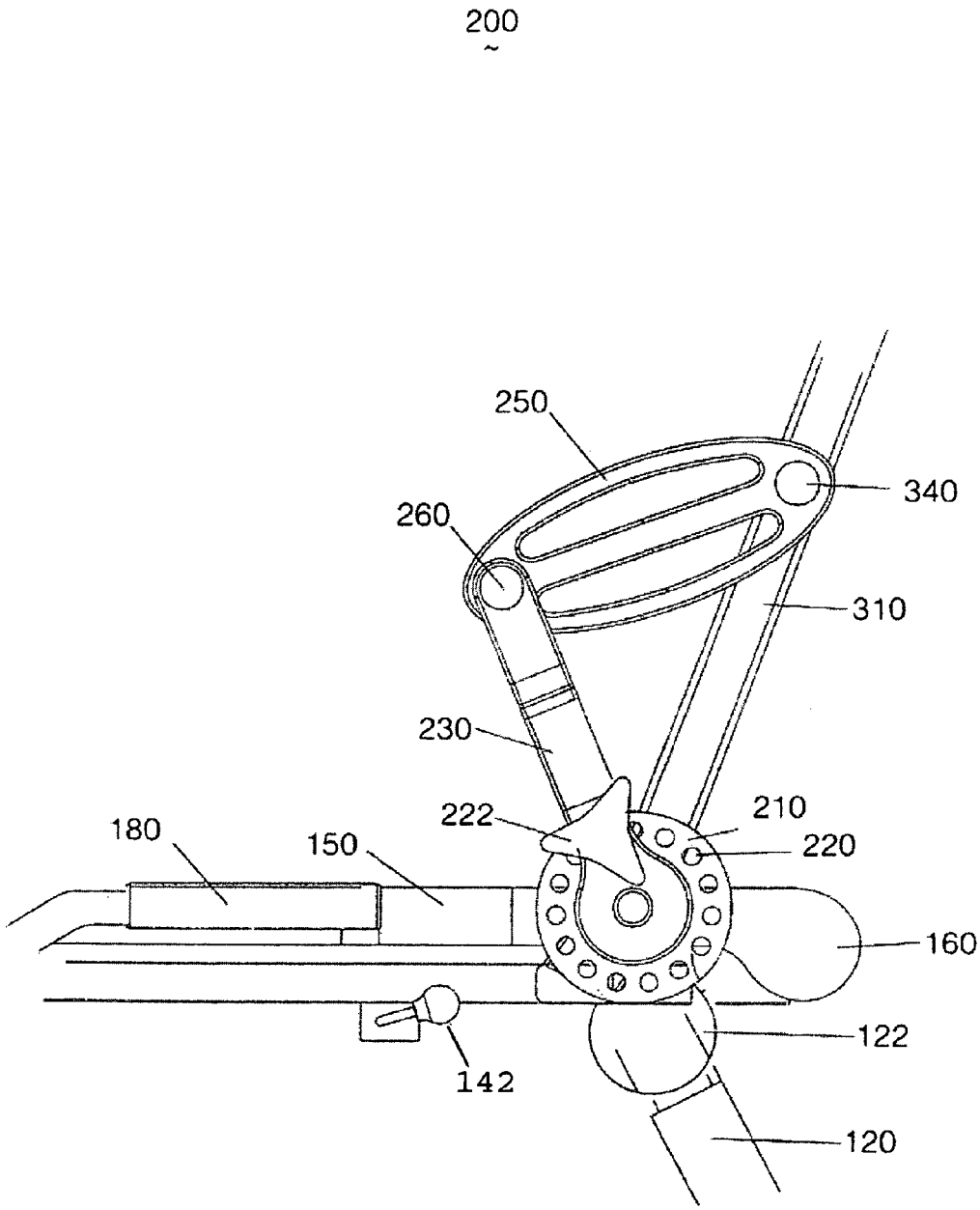
FIG. 6 is a bottom perspective view of the invention.

FIG. 6 is an exploded side view of the resistance assembly 200 of the invention. FIG. 6 shows front legs 120 with front legs folding joint 122, sliding bench lever 142, seat 150, seat front curved portion 160, and first handle 180. The resistance assembly 200 is shown with gear wheel 210, gear wheel holes 220, gearwheel adjustment knob 222, resistance arm 230, resistance band 250, and resistance attachment point 260. Also shown is the arm 310, and the band knob 340.

The resistance band 250 is attached on one end to the arm assembly 300 through the band knob 340 which is on the arm 310. The resistance band 250 is attached on the other end to the resistance arm 230 through the resistance attachment point 260. In a preferred embodiment, a resilient band is used to provide resistance. In alternative embodiments, other means may be used to provide resistance, including but not limited to, friction devices, springs, pneumatic devices, torque-oriented resistance mechanisms, electronic resistance mechanisms, magnetic resistance mechanisms, or any other mechanism for providing resistance that may be adaptable to the invention.

The resistance band 250 or other resistance mechanism may be manufactured from any material, including but not limited to, rubbers, plastics, thermoplastics, elastomers, glass such as fiberglass, wood or wood products, fabrics, metals, or any combination of these materials or other materials.

Figure 7:
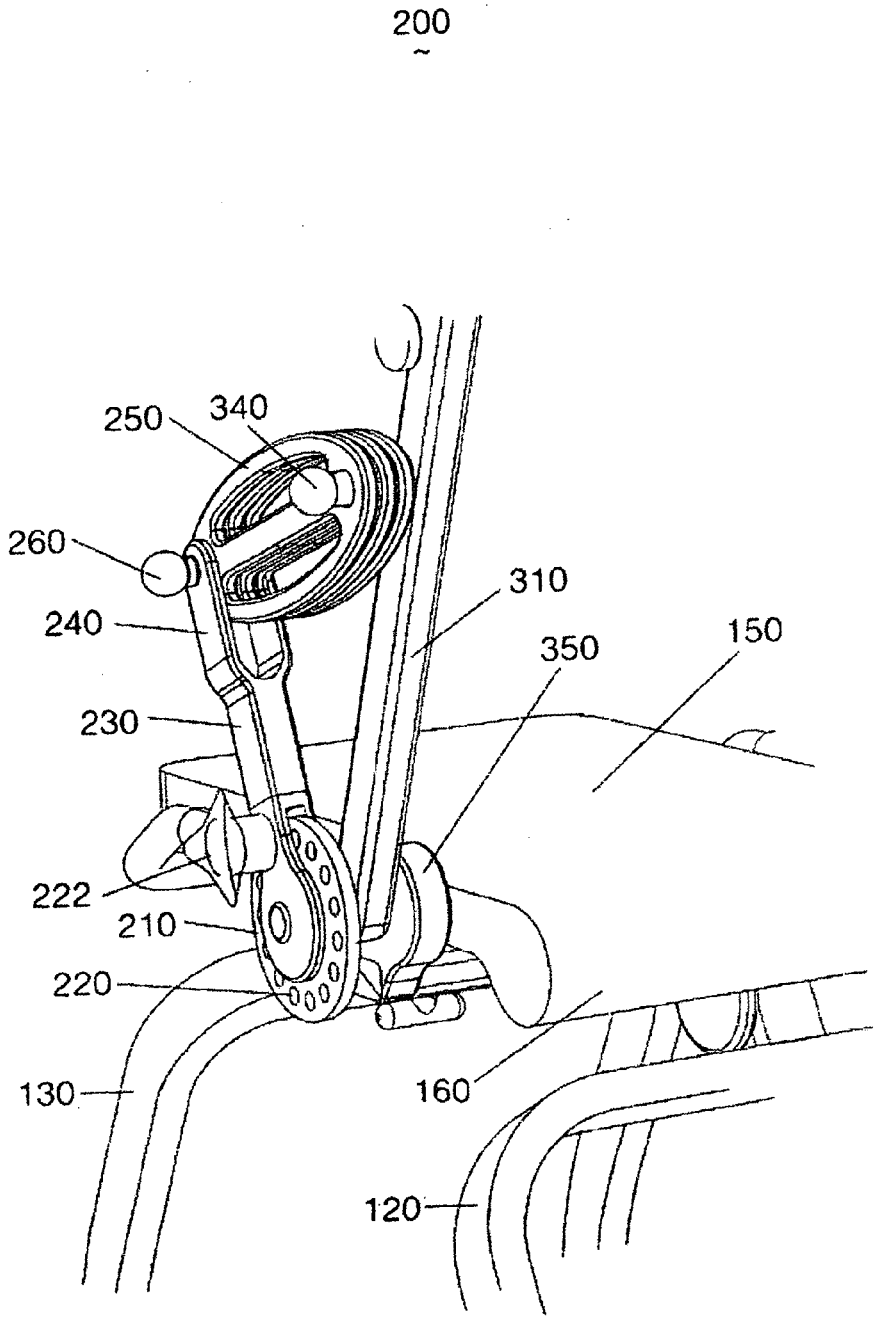
FIG. 7 is an exploded side view of the resistance assembly of the invention.

FIG. 7 is an exploded perspective view of the resistance assembly 200 of the invention. FIG. 7 shows front legs 120, sliding bench lever 142, seat 150, and seat front curved portion 160. The resistance assembly 200 is shown with gear wheel 210, gear wheel holes 220, gearwheel adjustment knob 222, resistance arm 230, resistance attachment means 240, resistance band 250, and resistance attachment point 260. Also shown is the arm 310, the band knob 340, and the arm assembly attachment point 350.

FIG. 7 illustrates the invention with a plurality of resistance bands 250, as it may be employed by an advanced user. As can be seen in FIGS. 6 and 7, adding or removing resistance bands is straightforward, quick, and easy. The user simply removes the band knob 340, adds or subtracts bands, then replaces the band knob 340.

Figure 8:
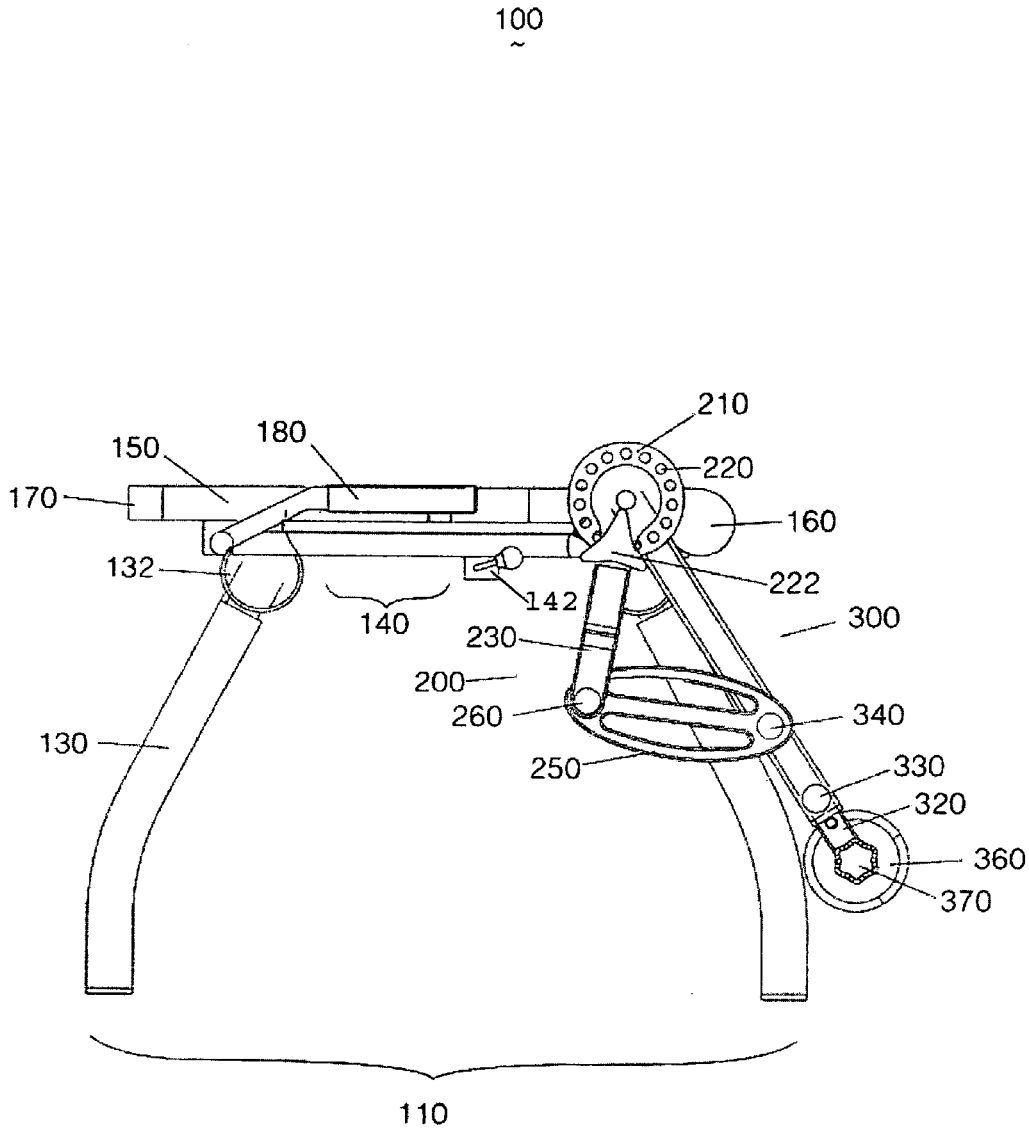
FIG. 8 is an exploded perspective view of the resistance assembly of the invention.

FIG. 8 is a side view of the invention, core trainer 100. Core trainer 100 has support assembly 110, illustrated with front legs 120, rear legs 130, rear legs folding joint 132, seat assembly 140, sliding bench lever 142, seat 150, seat front curved portion 160, seat rear curved portion 170, and a first handle 180.

FIG. 8 also shows the resistance assembly 200, with gear wheel 210, gear wheel holes 220, gearwheel adjustment knob 222, resistance arm 230, resistance band 250, and resistance attachment point 260. Also shown is the arm assembly 300, arm extension 320, band knob 340, press bar 360, and press bar attachment point 370.

FIG. 8 illustrates one means in which the core trainer 100 may be used to exercise the user's legs. In this embodiment, one exercise the user may perform involves the user sitting on the seat 150 and placing his ankles under the press bar 360, then lifting up on the press bar 360. The user may also grasp the handles 180 and 190 to brace himself. Also, comparing FIG. 8 to FIG. 5, it can be seen that the seat 150 is in a different position. In FIG. 5 the seat has been moved forward, and in FIG. 8 the seat has been moved rearward.

Figure 9:
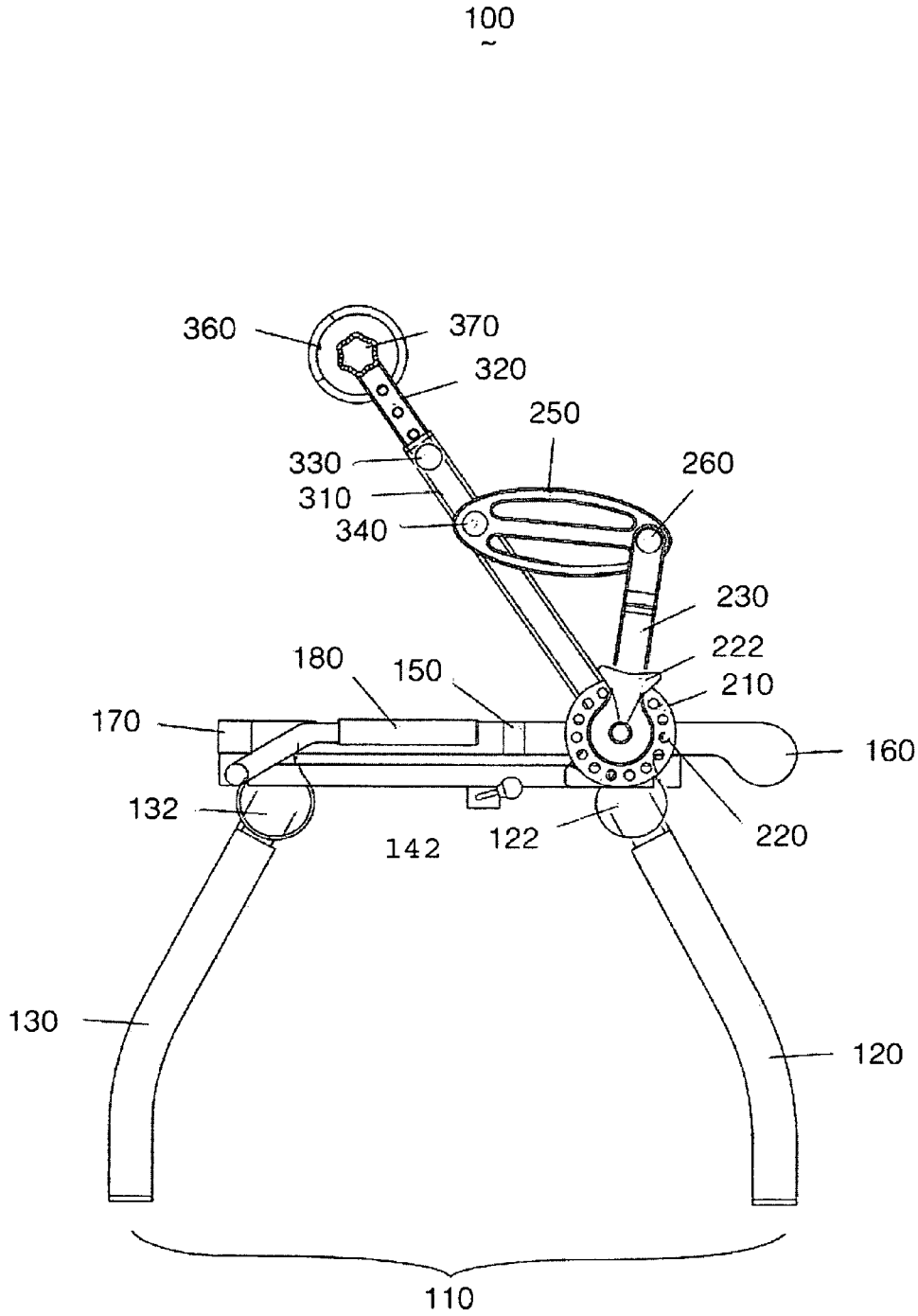
FIG. 9 is side view of the invention in an alternate form of the embodiment.

FIG. 9 is a side view of the invention, core trainer 100. Core trainer 100 has support assembly 110, which consists of front legs 120, front legs folding joint 122, rear legs 130, rear legs folding joint 132, seat assembly 140, sliding bench lever 142, seat 150, seat front curved portion 160, seat rear curved portion 170, and a first handle 180.

FIG. 9 also shows the resistance assembly 200, with gear wheel 210, gear wheel holes 220, gearwheel adjustment knob 222, resistance arm 230, resistance band 250, and resistance attachment point 260. Also shown is the arm assembly 300, with arm 310, arm extension 320, band knob 340, press bar 360, and press bar attachment point 370. FIG. 9 shows that arm 310 can be positioned over seat 150, and could for example be used for various arm and back exercises.

Figure 10:
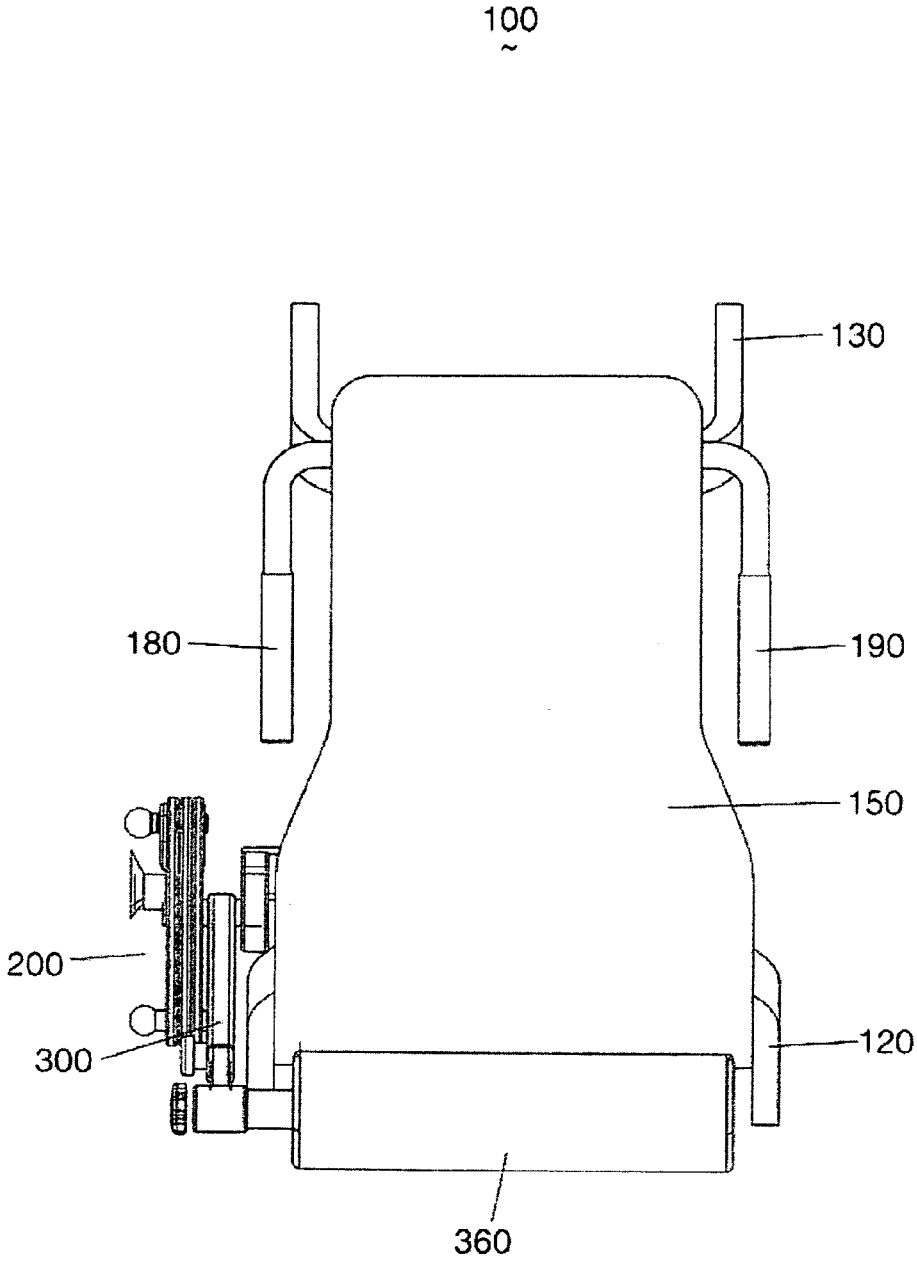
FIG. 10 is a top view of the invention.

FIG. 10 is a top view of the core trainer 100. FIG. 9 shows front legs 120, rear legs 130, seat 150, first handle 180, second handle 190, resistance assembly 200, arm assembly 300, and press bar 360.

Figure 11:
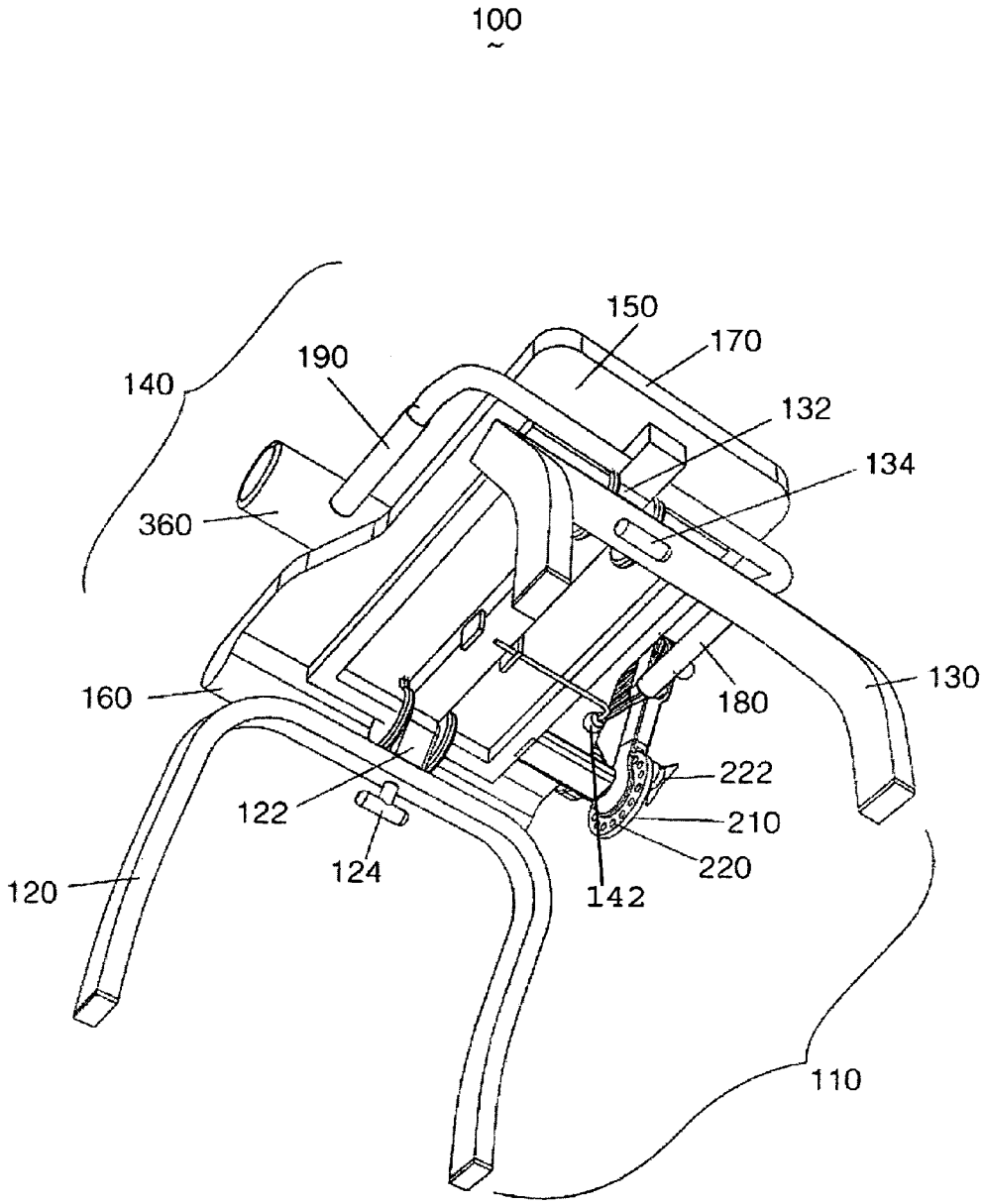
FIG. 11 is bottom perspective view of the invention in an alternate form of the embodiment.

FIG. 11 is a bottom perspective view of the invention, core trainer 100. Core trainer 100 has support assembly 110, which consists of front legs 120, front legs folding joint 122, front legs pin 124, rear legs 130, rear legs folding joint 132, rear legs pin 134, seat assembly 140, seat 150, seat front curved portion 160, seat rear curved portion 170, and a second handle 190. FIG. 6 also shows the gear wheel 210, with gear wheel holes 220, and press bar 360.

Figure 12:
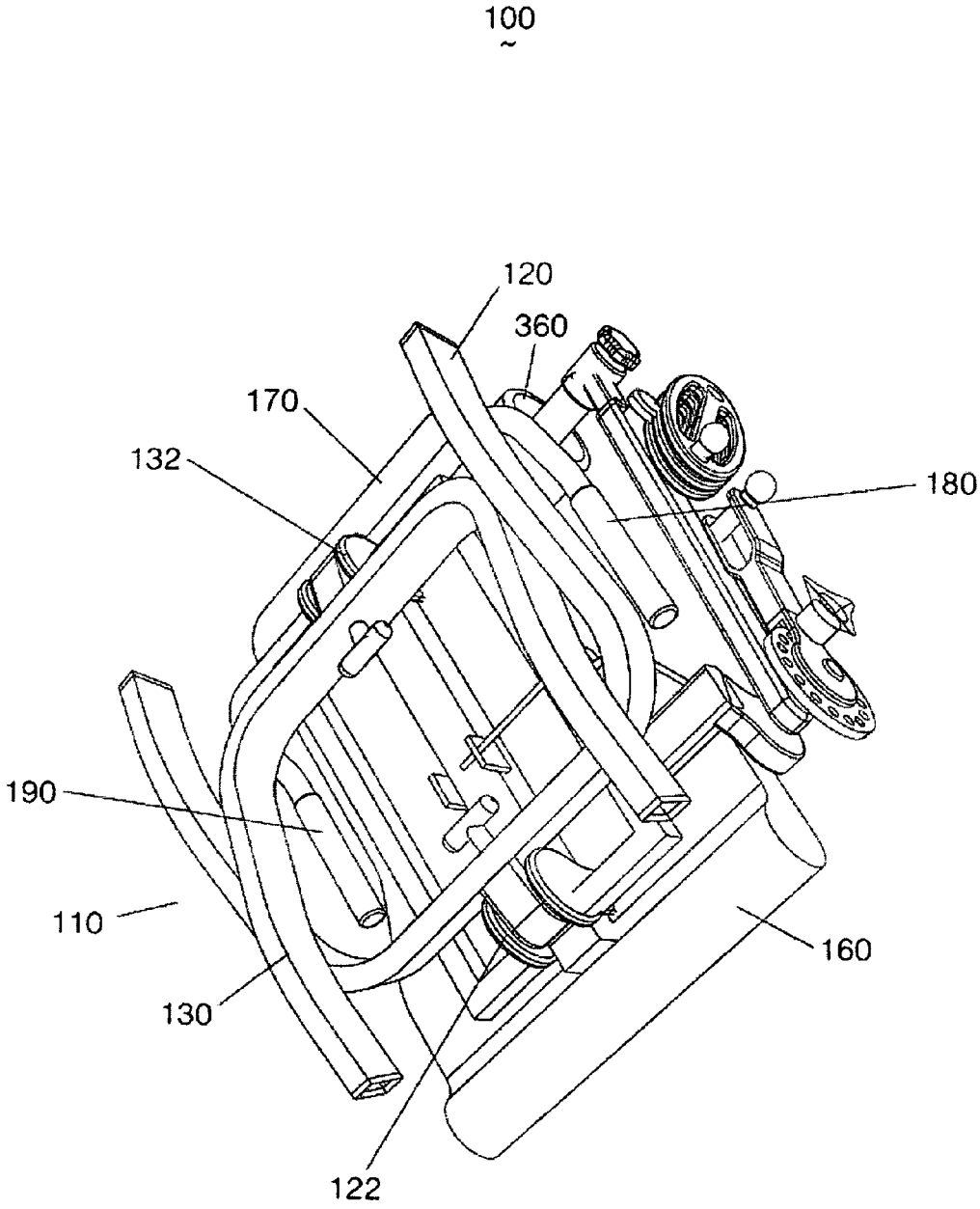
FIG. 12 is a bottom perspective view of the invention in a folded state.

FIG. 12 is a bottom perspective view of the core trainer 100. FIG. 11 shows support assembly 110, with front legs 120, front legs folding joint 122, rear legs 130, rear legs folding joint 132, seat 150, seat front curved portion 160, seat rear curved portion 170, second handle 190, and press bar 360.

FIGS. 11 and 12 illustrate advantages inherent in the seat assembly 140. The front legs 120 and rear legs 130 may be folded such that, when combined with the proper positioning of the arm assembly 300, the invention folds into a compact unit that is easy to store and transport. The folding mechanism for the legs may be any number of mechanisms, including but not limited to, a joint that locks in place when the legs are extended, a pin mechanism that holds the legs in the desired position, or an axle.

Another feature of the core trainer 100 is that the front legs 120 and rear legs 130 may be adjusted to allow for users of varying heights. A knob may be employed that allows the user to adjust the angle of protrusion of the legs from the seat assembly, thus varying the height of the seat.

The core trainer 100 employs knobs in various places. The term 'knob' is meant to apply to joining devices that may be knobs or any other suitable object, of any shape, and employed in any manner, including but not limited to, screw in devices, push in devices, spring-pressured devices, or any type of method or device that allows the core trainer parts to be joined.

All of the components of the core trainer 100 may be made from any materials deemed suitable, including but not limited to, metals, fabrics, rubbers, plastics, thermoplastics, elastomers, wood or wood products, glass or glass products, animal products, or any combination of these materials or other materials.

The overall dimensions of the core trainer 100 may vary. It is contemplated that the invention may be made in different sizes for men and women, or in a smaller size for children. Generally speaking, the core trainer will have an overall height, in a preferred embodiment, of about 1020 mm, with a height to the top surface of seat 150 of about 456 mm. It will also preferably have an overall length, as determined as the distance from the front legs 120 to the rear legs 130 of about 880 mm, and a width of about 635 mm. Of course, these dimensions are given for illustrative purposes only and can be varied substantially.

Although this invention has been described with a certain degree of particularity, it is to be understood that the present disclosure has been made only by way of illustration and that numerous changes in the details of construction and arrangement of parts may be resorted to without departing from the spirit and the scope of the invention.

We claim:

1. An exercise machine comprising:

a support assembly having front legs, rear legs, and a seat assembly;

a resistance assembly, having a gear wheel fixed to the support assembly, a resistance arm rotatably attached to the gear wheel, the resistance arm having means to adjustably affix the resistance arm to the gear wheel;

the resistance arm having a resistance attachment means; and an arm assembly having an attachment point, and a resistance band having an end attached to the attachment point and the other end attached to a resistance attachment point on the resistance arm, wherein the resistance arm and arm assembly can be rotatably adjusted from 0 to 360 degrees.

2. The exercise machine of claim 1, wherein the seat assembly is moveable.

3. The exercise machine of claim 1, wherein the seat assembly contains a seat with a curved portion on one or both ends.

4. The exercise machine of claim 1, wherein the arm assembly includes a horizontal or vertical press object, and the object is a bar or a roller.

5. The exercise machine of claim 1, wherein the arm assembly is adjustable for height.

6. The exercise machine of claim 1, wherein the arm assembly and resistance arm are positionally adjustable in relation to the seat assembly.

7. The exercise machine of claim 1, wherein the seat assembly has at least one handle.

8. The exercise machine of claim 1, wherein the seat assembly has an extension.

9. The exercise machine of claim 1, wherein the resistance band is a spring.

10. The exercise machine of claim 1, wherein the resistance band is rubber.

11. The exercise machine of claim 1, further comprising a plurality of rubber resistance bands.

12. The exercise machine of claim 1, wherein the seat has an underside, and the legs of the seat assembly fold against the underside of the seat assembly.

13. The exercise machine of claim 1, wherein the arm assembly, resistance arm, and legs of the seat assembly fold to yield a compact machine.

14. The exercise machine of claim 1, wherein the legs of the seat assembly have attachments for exercise bands.

15. The exercise machine of claim 1, wherein the unit has one or more handles.

16. The exercise machine of claim 1, wherein the unit may have one or more leg attachments.

* * * * *